United States Patent [19]

Bennett et al.

[11] Patent Number: 4,692,081

[45] Date of Patent: Sep. 8, 1987

[54] RISER PIPE ELEVATOR

[76] Inventors: William Bennett, Ste. 2100, 935 Gravier St., New Orleans, La. 70112; Angel F. Jimenez, P.O. Box 2769-70459, Slidell, La. 70458

[21] Appl. No.: 705,102

[22] Filed: Feb. 25, 1985

[51] Int. Cl.[4] ..... E21B 19/14

[52] U.S. Cl. ..... 414/22; 211/70.4; 212/213; 414/745

[58] Field of Search ..... 211/70.4; 414/22, 745, 414/786; 175/52, 85, 8; 212/213

[56] References Cited

U.S. PATENT DOCUMENTS

| | | | |
|---|---|---|---|
| 2,999,605 | 9/1961 | Jarnett | 414/22 |
| 3,539,024 | 11/1970 | Irons et al. | 414/22 X |
| 3,937,334 | 2/1976 | Bleyl et al. | 414/22 |
| 3,949,693 | 4/1976 | Bauer et al. | 114/124 X |
| 3,987,910 | 10/1976 | Brunato | 414/22 |
| 4,335,792 | 6/1982 | Mahan | 175/52 |
| 4,444,275 | 4/1984 | Beynet et al. | 175/7 |
| 4,445,579 | 5/1984 | Bello | 211/70.4 X |
| 4,502,551 | 3/1985 | Rule et al. | 175/8 X |

FOREIGN PATENT DOCUMENTS

| | | | |
|---|---|---|---|
| 2918817 | 11/1980 | Fed. Rep. of Germany | 175/85 |

*Primary Examiner*—Robert J. Spar
*Assistant Examiner*—Janice Krizek
*Attorney, Agent, or Firm*—Keaty & Keaty

[57] ABSTRACT

An elevator for storing and retrieving riser pipe in a semi-submersible unit is disclosed. The riser pipe is stored in a annular caisson below the floor of the semi-submersible unit in surrounding relationship to the drill center of the unit. The annular caisson forms a magazine in which the riser pipe is vertically stored. The riser pipe is moved in and out of the magazine in a telescopic elevator which raises the riser pipe and tilts it so that it moves through the floor of the semi-submersible unit at an angle to the vertical.

25 Claims, 8 Drawing Figures

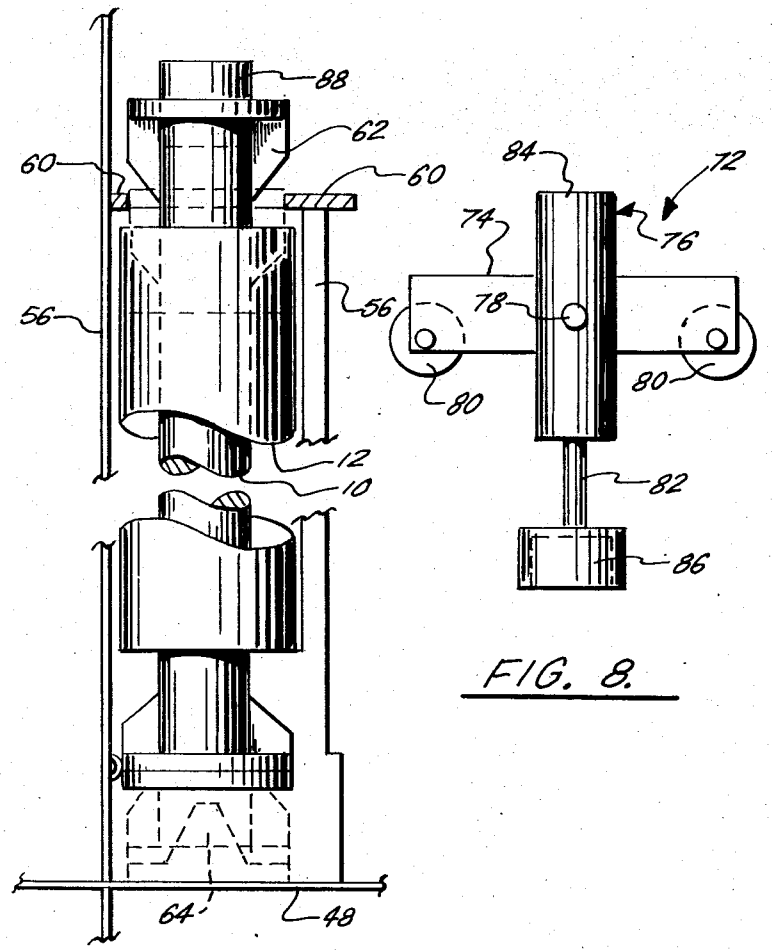
FIG. 8.
FIG. 7.
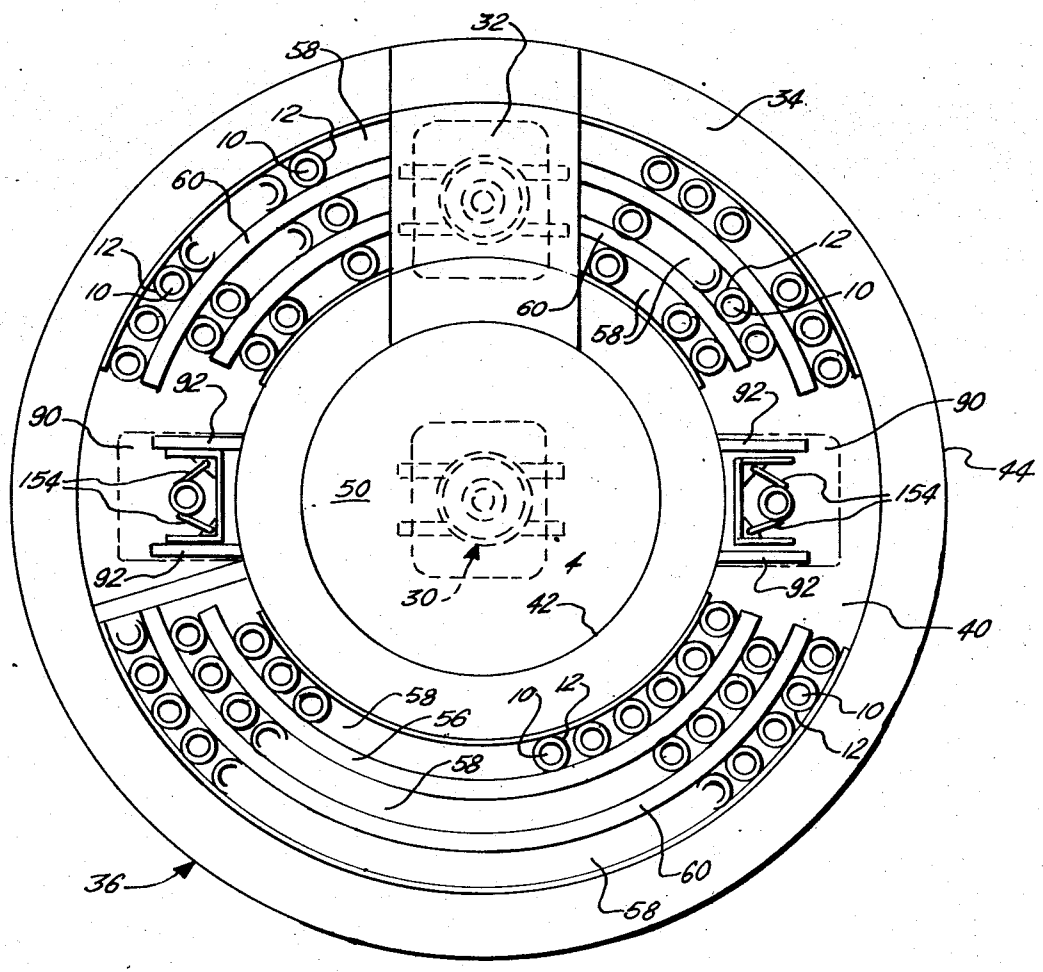
FIG. 6.

RISER PIPE ELEVATOR

BACKGROUND OF THE INVENTION

1. Field of the Invention

This invention concerns a device for storing riser pipe in a semi-submersible drilling unit used in offshore oil exploration and production. More particularly, it concerns an elevator for moving the riser pipe in and out of the storage device.

2. General Discussion of the Background of the Invention

It has recently been disclosed in co-pending application Ser. No. 567,228 filed Dec. 30, 1983, now U.S. Pat. No. 4,646,672, that providing an annular, buoyant central column for semi-submersible drilling units reduces heave characteristics of semi-submersibles while providing a storage chamber for vertically oriented riser pipe. Storage of the riser pipe in a vertical orientation around the moon pool of a drilling unit, however, presented certain drawbacks.

Among the drawbacks which arose from the vertical storage of the riser pipe was the undesirability of elevating a 30–90 foot long riser pipe in a substantially vertical direction through the floor of a semi-submersible drilling unit. Vertical movement of a pipe through the floor resulted in the top of the riser pipe being presented at an inconvenient distance from the drill center of the semi-submersible unit. This was a serious drawback since the long riser pipe would then have to be moved through this distance towards the drill center line of the semi-submersible unit while the unit was being excited by waves and other environmenal forces.

The applicants of the present invention were also confronted with the problem of keeping the riser pipe under positive control along its length during storage and retrieval of the pipe to prevent it from oscillating in response to movements of the drilling unit.

Yet another problem was encountered as the center of gravity of the pipe moved through the floor and exerted harmful bending moments on running tools that were lifting the pipe.

A solution to all of these problems had to be found within the geometric limitations imposed by the central caisson. Since the cross-sectional area of the caisson which intersected the surface of the water could not exceed certain dimensions without adversely affecting the motions of the platform, a method of storing and retrieving the riser pipe had to be found that did not involve a substantial increase in the size of the annular caisson in which the pipe was stored.

Accordingly, it is an object of the invention to provide a method and apparatus for storing and retrieving riser pipe from an annular caisson around the drill center of a semi-submersible drilling unit without increasing the cross-sectional area of the caisson that intersects the water plane.

It is a further object of the invention to provide such a device that would elevate the riser pipe out of the caisson and move it through the floor of the drilling unit at an angle so that the riser pipe would be presented at a point adjacent the drill center of the seim-submersible drilling unit.

Yet another object of the invention is to provide an elevator that maintains the riser pipe under positive control along its length as the pipe is retrieved from the caisson.

Still another object of the invention is to move the riser pipe through the floor of the drilling unit at an angle such that the riser pipe can be easily controlled.

Finally it is an object of the invention to provide an elevator for riser pipe which can quickly store and retrieve the pipe.

SUMMARY OF THE INVENTION

The aforementioned objects have been achieved by providing an elevator for storing and retrieving the riser pipe in a semi-submersible unit, the elevator comprising an annular caisson below the cellar deck and drill floor of the semi-submersible unit in surrounding relationship to the drill center of the unit. The annular caisson forms a magazine which is comprised of an annular inside wall, an annular outside wall, a closed bottom and an open annular top. A plurality of upright stanchions are disposed concentrically within the annular magazine which separate the annular magazine into a plurality of annular pipe storage areas, the stanchions supporting an annular horizontal plate which provides support for vertically oriented riser pipes stored between the horizontal plates.

An overhead crane adjacent the top of the magazine has a gripping member for gripping a top of the riser pipe and moving it out of its stored position to an elongated elevated cage within the magazine. The elevator cage is comprised of an elongated outer member and an elongated inner member in telescopic relationship to one another. The outer cage is provided with a longitudinal rack which mates with a pinion fixed to the magazine for moving the outer member through a first distance relative to the magazine, from a stored position to an extended position. The inner member is provided with a longitudinal rack which mates with a pinion fixed to the outer member for moving the inner member through a second distance relative to the outer member, from a retracted position to an extended position.

A pivot cage is pivotally attached adjacent the top of the magazine for rotational movement about a substantially horizontal axis. The pivot cage has a selectively actuated pin that mates with an opening in the outer member to hold the inner member in fixed engagement with the pivot cage when the outer member is in the extended position. A hydraulic piston and cylinder assembly is fixed between the magazine and the pivot cage to move the pivot cage and elevator cage about the pivotal attachment between an upright orientation and a tilted orientation.

The riser pipe is placed in the elevator cage and moved substantially vertically upwardly towards the floor of the drilling unit. The outer member then engages with the pivot cage, and both the pivot cage and elevator cage are tilted. The inner member of the elevator cage is then extended to move the riser pipe the remaining distance from the top of the outer member to the opening in the floor of the semi-submersible drilling unit.

BRIEF DESCRIPTION OF THE DRAWINGS

FIG. 6 is a top view of the central caisson taken along lines 5—5 in FIG. 1, the blowout preventor being shown in phantom in a stored and operational position.

FIG. 7 is a fragmentary side view of a riser pipe disposed within the magazine formed by the annular caisson, phantom lines showing the riser pipe in its stored position.

FIG. 8 is an enlarged side view of a running tool suspended above the open annular top of the magazine, the running tool being used for moving riser pipe from its stored position in the magazine to the elevator cage.

DETAILED DESCRIPTION OF THE PREFERRED EMBODIMENT

The following detailed description of the preferred embodiment of the invention will provide a better understanding of its structure and function.

Figure 1:
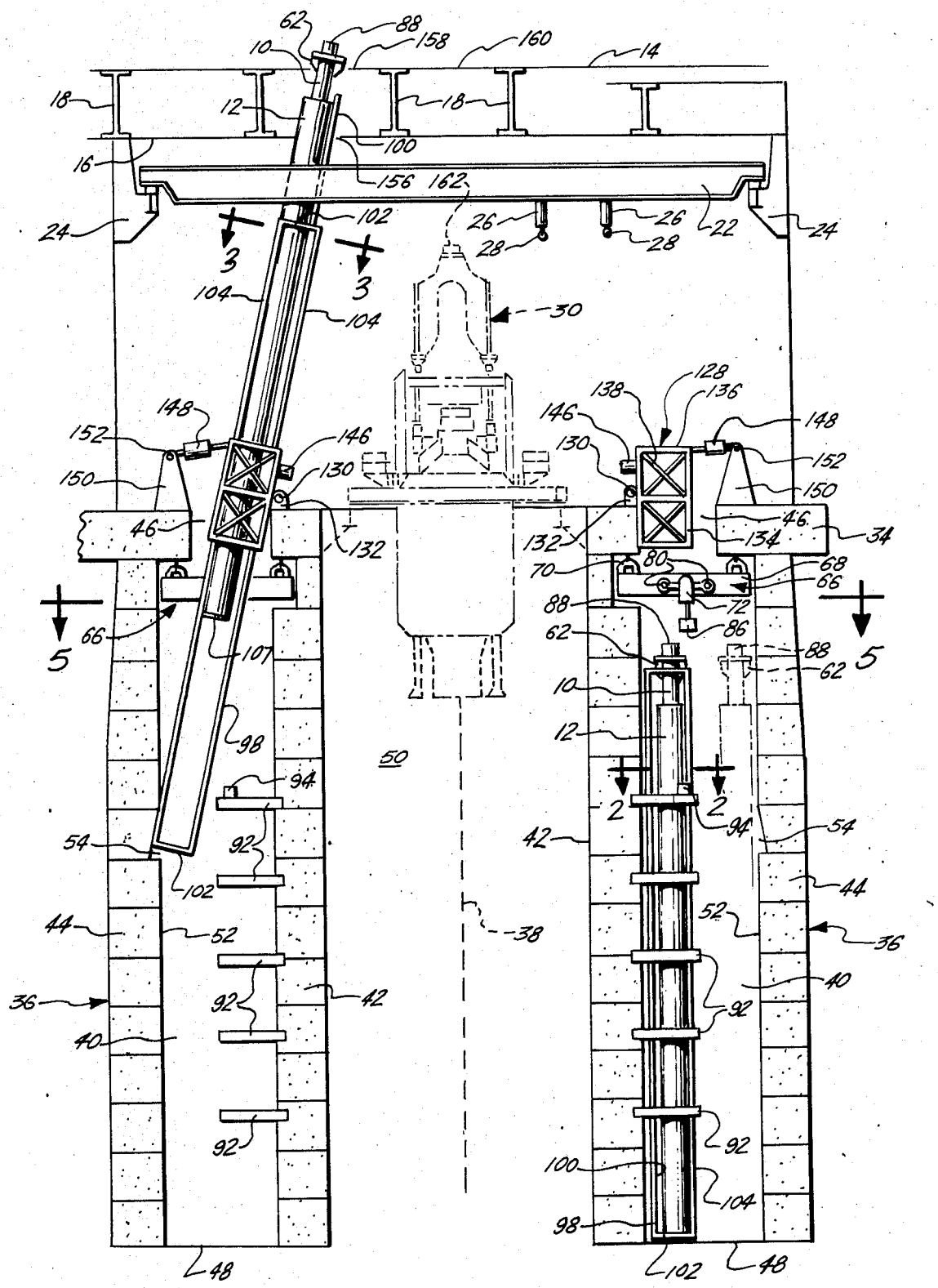
FIG. 1 is a cross-sectional view of a central caisson of a semi-submersible drilling unit showing the annular magazine in which the riser pipe is stored. Two elevator cages are shown, one in a vertical orientation before retrieval of a riser pipe has begun, the other showing the elevator cage in an extended, tilted position. A blowout preventor stack is shown in phantom over the moon pool defined by the caisson.

Turning first to FIG. 1, an elevator is shown for storing and retrieving a riser pipe 10 in a semi-submersible drilling unit. Riser pipe 10 is surrounded by a buoyant, Styrofoam TM jacket 12 which provides buoyant support for pipe 10 and permits more controlled movement of the pipe when it is submerged.

The semi-submersible drilling unit is comprised in part of a drill floor having an upper steel plate 14 and lower steel plate 16 held in spaced, parallel relationship by a plurality of I-beams 18. A blowout preventor crane is mounted just below the floor of the unit, and is comprised of a pair of parallel I-beams 22 (only one of which is shown in FIG. 1) fixed between a pair of opposing mounts 24. Travelling members 26 are mounted on wheels which travel between I-beams 22 so that members 26 can move in a direction longitudinal to I-beams 22. Members 26 are provided with grips 28 that can be attached to blowout preventor 30 (hereinafter BOP 30) for moving BOP 30 between an operational position (shown in FIG. 1) and a stored position (shown generally at 32 in FIG. 6).

An inner bottom 34 is fixed in spaced, parallel, relationship to steel plates 14, 16. An annular caisson 36 depends from inner bottom 34 in a manner more fully disclosed in co-pending application Ser. No. 567,228 filed Dec. 30, 1983 which is incorporated by reference. Briefly, caisson 36 is in surrounding relationship to a drill center line 38 of the drilling unit and provides buoyant support for the unit while reducing heave characteristics in oceans having surface waves of normally encountered periods. Caisson 36 forms a magazine 40 which is comprised of an annular, steel inside wall 42 and an annular, steel outside wall 44. Magazine 40 further has an open annular top 46 and a closed bottom 48 formed of an annular steel plate which seals the bottom of magazine 40. Inside wall 42 circumscribes a moon pool 50 (FIGS. 1 and 6) through which a drill string and riser column pass and through which drilling operations are performed.

An inside face 52 of annular outside wall 44 is provided with an indentation 54 which is placed adjacent the bottom of an elevator cage described below when the elevator cage is in a raised position. Indentation 54 may be annular or may be localized to the vicinity of the bottom of the elevator cage discussed below.

Referring now to FIG. 6 in combination with FIG. 1, a plurality of upright, stanchions 56 are disposed concentrically within annular magazine 40 and separate the annular magazine into a plurality of annular pipe storage areas 58. As can be seen in even greater detail in FIG. 7, stanchions 56 define a space therebetween which is slightly greater than the diameter of circular jacket 12 carried by pipe 10. Steel support plates 60 are fixed to the top of stanchions 56 to effectively reduce the width of the storage areas adjacent the open top of storage areas 58. The width of the open area between support plates 60 is just great enough to receive fins 62 of riser pipe 10 therebetween in snugly fitting engagement. Stanchions 56 and plates 60 are thereby in supporting relationship to the vertically oriented riser pipes 10 stored between stanchions 56.

Additional support for the stored riser pipes is provided by a pipe holding element 64 (FIG. 7) which, in preferred enbodiments, is a cylindrical rubber platform with an upwardly protruding rubber cone which fits into the open, female end of a stored riser pipe. In the embodiment shown in FIG. 7, the female end of the riser pipe is stored at the bottom of magazine 40. In other embodiments, the male end could be stored adjacent closed bottom 48 of magazine 40, in which case pipe holding element 64 could be configured to fit in pipe holding engagement with the male end of the riser pipe.

An overhead travelling crane 66 (FIG. 1) is disposed inside magazine 40 adjacent open annular top 46. Crane 66 is comprised of a beam 68 that is carried circumferentially around the interior of magazine 40 by suspending members 70 which move along an arcuate track around the interior of the magazine. As shown in FIG. 1, a running tool 72 is mounted on beam 68 for radial movement with respect to annular magazine 40. Running tool 72 is shown in greater detail in FIG. 8 wherein it is seen to be comprised of a horizontal member 74 having a vertical member 76 attached thereto by a bolt 78. Horizontal member 74 is provided with motorized wheels 80 that move in a track along beam 68. Vertical member 76 is further comprised of a fluid actuated piston 82 and cylinder 84 for advancing and retracting a gripping member 86 which grips a top of riser pipe 10. The interior or gripping member 86 is configured to fit over, for example, a male end of riser pipe 62. The interior of gripper member 86 is provided with fluid actuated pistons that move into gripping engagement with male projection 88 (FIG. 7) of riser pipe 10 to hold it firmly within the gripping member 86 illustrated in FIG. 8. The fluid actuated pistons on the interior of gripping member 86 are not shown in the drawings.

Figure 2:
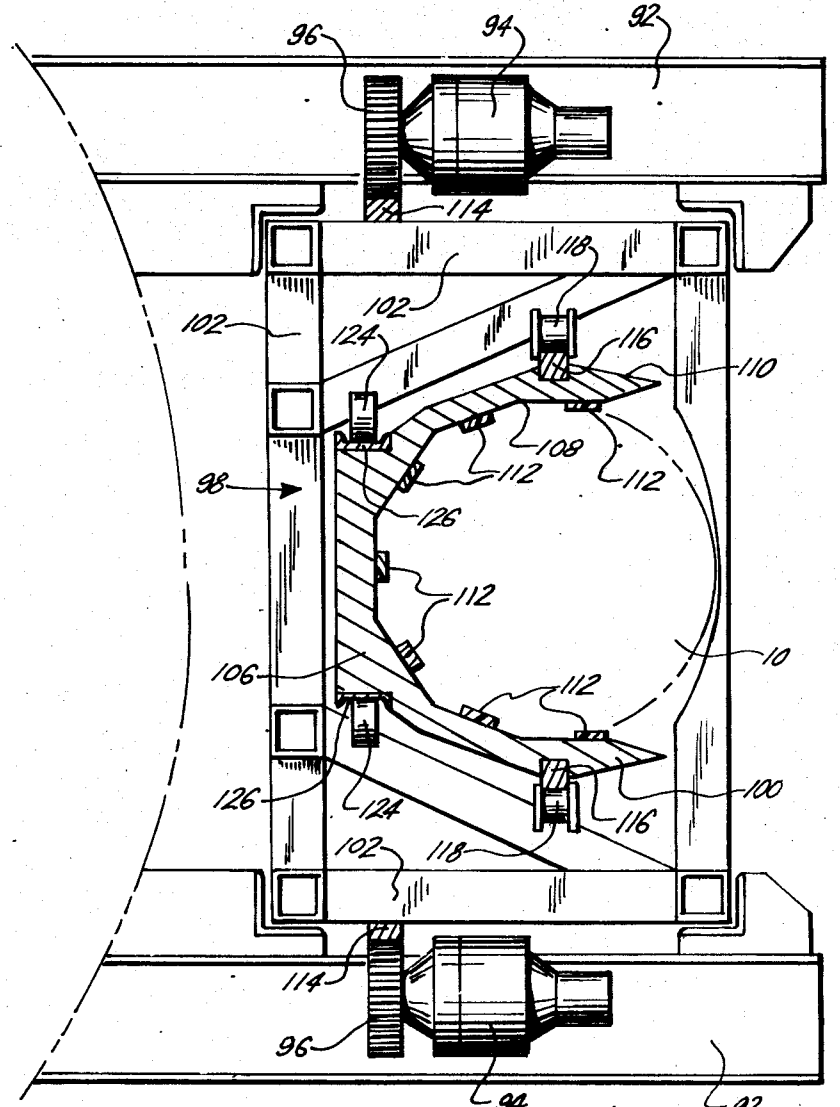
FIG. 2 is a cross-sectional view taken along section line 2—2 of FIG. 1 showing the outer member of the elevator cage.

An elevator region defined by broken lines is generally described by the reference numeral 90 in FIG. 6. This region is partially defined by a plurality of stationary, horizontal, opposing, parallel struts 92. On the topmost of these struts is mounted a pair of motors 94 which each drive a pinion 96 (FIG. 2). An elongated elevator cage is located within region 90 of magazine 40 between struts 92 for raising riser pipe 10 out of the open top 46 of annular magazine 40. The elevator cage is comprised of an elongated outer member 98 and an elongated inner member 100 in telescopic relationship to one another. Member 98 is a cage like structure constructed of horizontal supports 102 which are interconnected with vertical supports 104 (FIGS. 1 and 2). Inner member 100, on the other hand, is comprised of an elongated, arcuate plate 106 that extends substantially the entire vertical length of jacket 12 of riser pipe 10. A horizontal lip 107 is connected to the bottom of plate 106 to support the pipe within inner member 100 (FIG. 1). Plate 106 is configured to present a polygonal inner face 108 (FIGS. 2–4) and substantially arcuate outer face 110. A plurality of elongated strips 112 of polytetrafluoroethylene (or other similar low coefficient of friction material) are disposed longitudinally along the polygonal inner face 108 of plate 106. Strips 112 help avoid harmful frictional engagement between the jacket 12 of pipe 10 and inner face 108 as pipe 10 is moved along inner face 108 in a manner to be described below.

Outer member 98 is provided with a longitudinal rack 114 along substantially its entire length (FIG. 2) for mating with pinion 96 which is driven by moor 94. Pinion 96 mates with rack 114 to move outer member 98 through a first distance relative to the magazine, from a stored position shown at the right hand side of FIG. 1 to an extended position shown at the left hand side of FIG. 1. A pair of longitudinal racks 114 are provided in the preferred embodiment shown in FIG. 2, wherein a longitudinal rack, pinion 96 and motor 94 are provided on each side of outer member 98.

Figure 3:
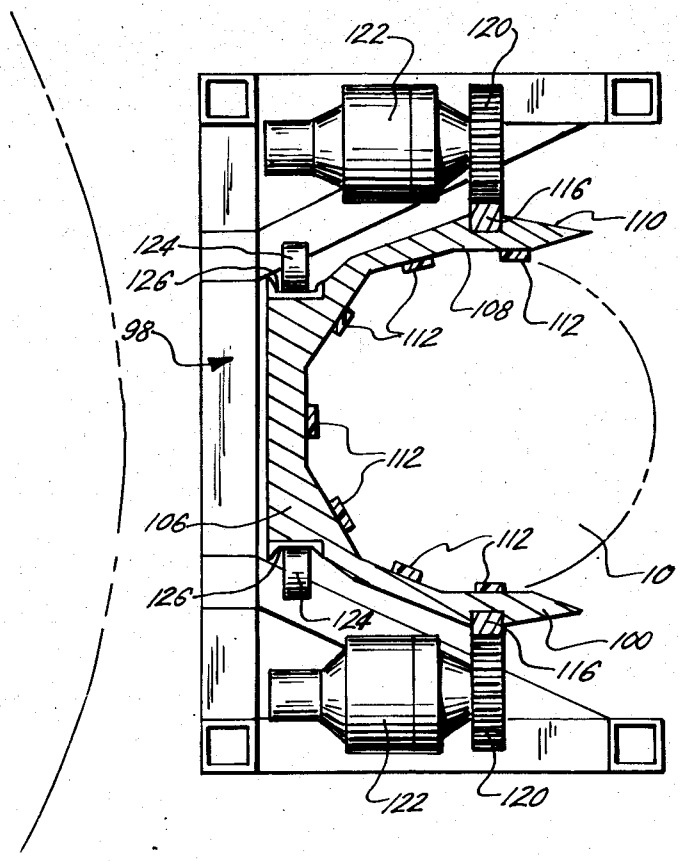
FIG. 3 is a cross-sectional view taken along section line 3—3 of FIG. 1, showing the inner member of the elevator cage.

Inner member 100 is similarly provided wtih a pair of longitudinal racks 116 along substantially the entire length of inner member 100 (FIG. 3). Roller bearings 118 (FIG. 2) are rotationally mounted to outer member 98 adjacent racks 116 to provide a rolling surface against which racks 116 can move freely when not in engagement with pinions 120 of motors 122 mounted to outer member 98. Similar roller bearings 124 are rotationally mounted to outer member 98 to provide a rolling surface against which bearing face 126 of inner member 100 can ride as inner member 100 is being moved relative to outer member 98.

Gripping arms 154 are pivotally mounted adjacent the top of inner member 100 (see FIG. 6) for powered movement between an open position in which the arms do not engage pipe 10 and a closed position in which arms 154 firmly hold pipe 10 in place within inner member 100. The closed position of the arms is shown in FIG. 6.

Longitudinal rack 116 of inner member 100 mates with pinion 120 of motor 122 fixed to outer member 98 for movement of inner member 100 through a distance relative to outer member 98, from a retracted position within outer member 98 to an extended position such as that shown on the left hand side of FIG. 1.

Figure 5:
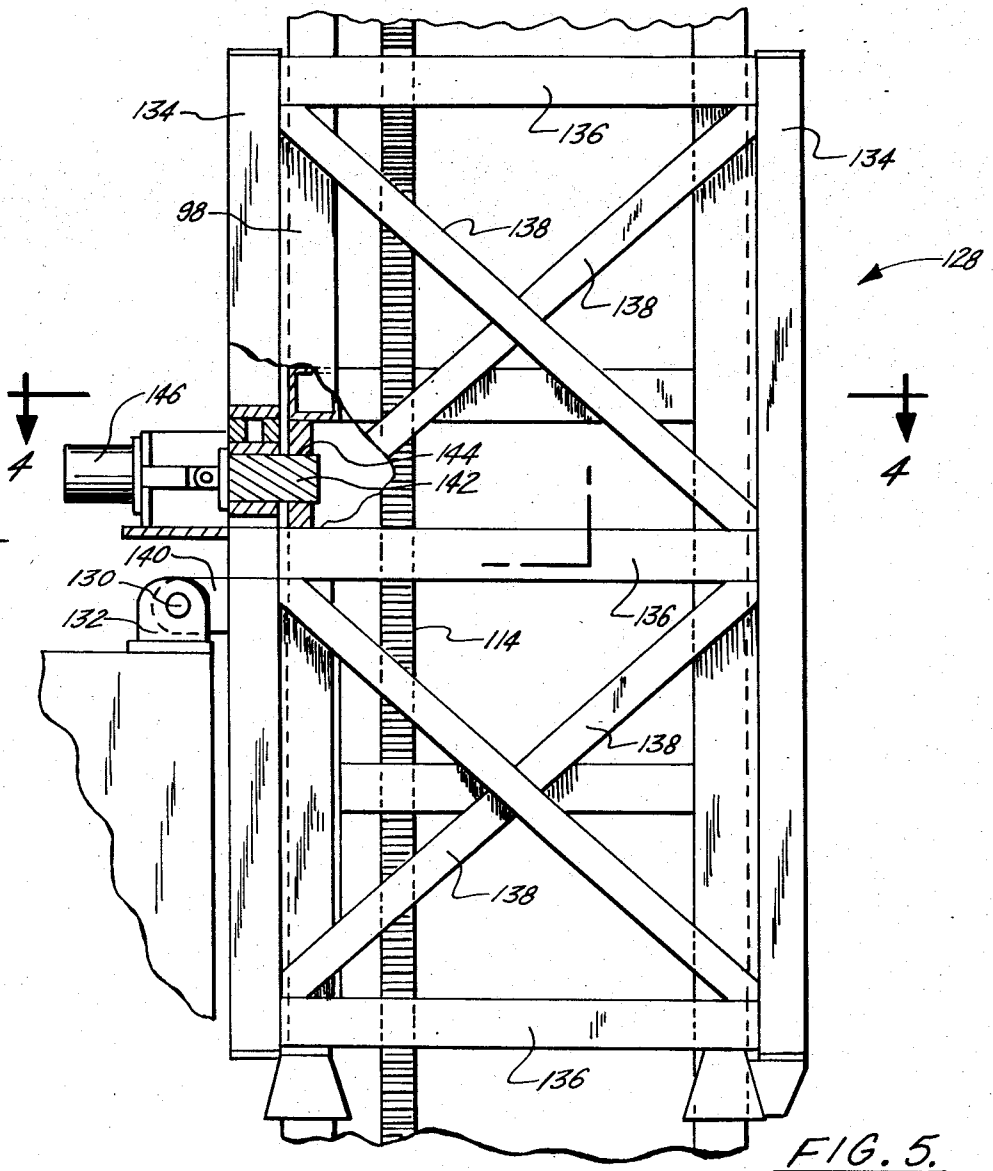
FIG. 5 is a side elevational view of the pivot cage in engagement with the elevator cage, portions of the pivot cage being broken away to shown the pin which holds the elevator cage in engagement with the pivot cage.
Figure 4:
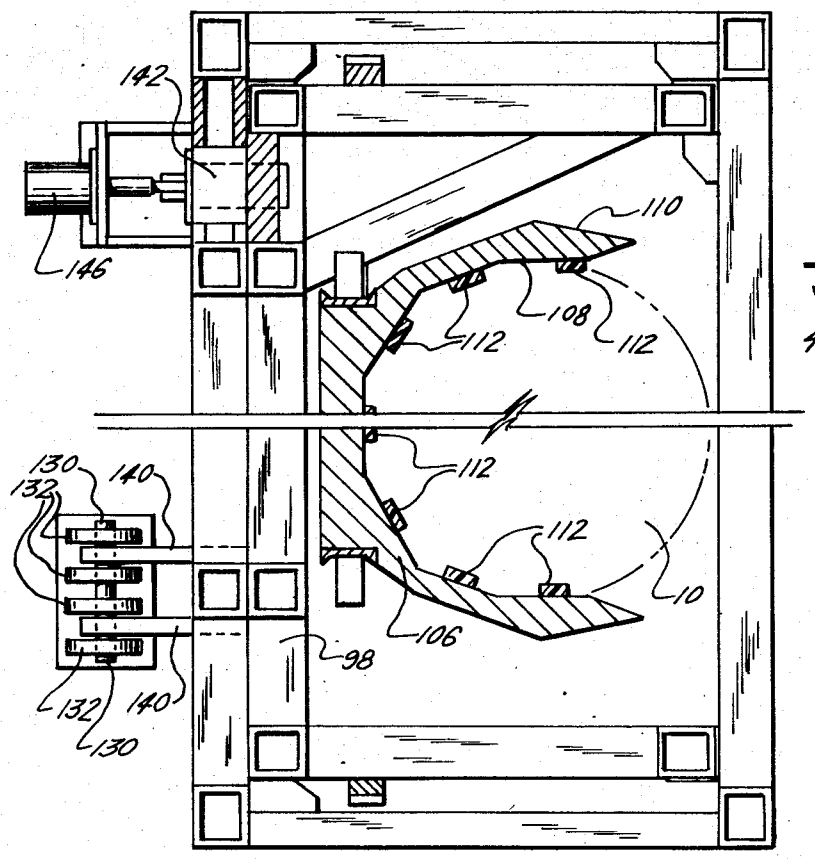
FIG. 4 is a cross-sectional view taken along section lines 4—4 of FIG. 5, showing the pivot cage in which the elevator cage is tilted.

A pivot cage 128 is pivotally attached adjacent open top 46 of magazine 40 for rotational movement about a substantially horizontal axis defined by a pivot pin 130 carried between upright, opposing pivot plates 132 (FIG. 4). As best seen in FIG. 5, pivot cage 128 is comprised of a plurality of vertical members 134 interconnected by horizontal members 136, diagonal supports 138, and protruding tongue 140 which is carried between pivot plates 132 by pivot pin 130.

Pivot cage 128 is provided with a selectively actuated pin 142 that mates with a pin receiving opening 144 in outer member 98 to hold outer member 98 in selectively fixed engagement with pivot cage 128 when outer member 98 is in the extended position shown at the lefthand side of FIG. 1. Pin 142 is moved by a fluid actuated piston and cylinder assembly 146 carried by pivot cage 128. Assembly 146 can be actuated either manually or automatically when pin receiving opening 144 moves into alignment with pin 142.

As seen in FIG. 1 another fluid actuated piston and cylinder assembly 148 is connected between a pair of upright standards 150 carrying a pivot pin 152 therebetween. The other end of assembly 148 is connected to a topmost portion of pivot cage 128.

In operation, the riser pipe 10 is stored in magazine 40 of annular caisson 36 below inner bottom 34 in surrounding relationship to drill center line 38 of the unit. Caisson 36 is constructed in accordance with the disclosure of co-pending application Ser. No. 567,228 filed Dec. 30, 1983 and provides buoyant support for the semi-submersible unit with a reduction in heave characteristics when surface waves are of a normally encountered frequency. Riser pipe 10 is stored in a substantially vertically oriented position within magazine 40 in a manner shown in FIGS. 6 and 7 of the drawings. Since the distance between stanchions 56 is only slightly greater than the diameter of cylindrical jacket 12, movement of pipe 10 is greatly restricted. Further, the rubber cone of pipe holding element 64 is inserted within the open female end of riser pipe 10 to maintain pipe 10 in its vertical orientation between stanchions 56. Support plates 60 snugly engage opposing fins 62 of pipe 10 to further maintain it in a stationary position.

When one desires to remove pipe 10 from the magazine, overhead travelling crane 66 is circumferentially moved around the top of magazine 40 until it is stopped above the desired riser pipe. Running tool 72 is then radially oriented over the appropriate compartment by actuation of wheels 80. When gripping member 86 is directly above projection 88 of pipe 10, the fluid actuated piston 82 is extended from cylinder 84 to move gripping member 86 towards projection 88. When the interior cavity of gripping member 86 is in engagement around projection 88, pistons on the inside of gripping member 86 are actuated to firmly engage projection 88. Piston 82 is then retracted to lift pipe 10 from the piston shown in phantom in FIG. 7 to that position shown in solid lines. Pipe 10 is thereby lifted so that fins 62 are above support plates 60 and pipe 10 with jacket 12 can freely move circumferentially within the area 58 in which it is stored. Overhead travelling crane 66 is then actuated to circumferentially convey pipe 10 from its stored position towards elevating region 90. As crane 66 reaches the end of partitions 56, it may be necessary to again move wheels 80 of running tool 72 to manipulate pipe 10 around struts 92 and into the elevator cage. When pipe 10 is placed within inner member on top of lip 107, gripping member 86 releases projection 88 and gripping arms 154 are immediately activated to move from the open position to a pipe engaging position shown in FIG. 6 wherein arms 154 firmly hold pipe 10 to provide positive control of the top of the pipe during elevation.

After arms 154 have firmly engaged pipe 10, motor 94 is actuated to begin turning pinion 96 which engages longitudinal rack 114 of outer member 98 to move member 98 from a stored position (shown at the right hand side of FIG. 1) to an extended position (shown at the left hand side of FIG. 1). When outer member 98 reaches a fully extended position, pin 142 moves under the influence of assembly 146 into pin receiving opening 144 of outer member 98. After pin 142 has firmly engaged outer member 98, the direction of motor 94 is reversed and pinion 96 is moved over a very short distance a direction opposite to the direction it moved when extending outer member 98. This reverse movement of piston 96 moves outer member 98 back on to pin 142 so that the weight of the elevator cage is placed on pin 142.

Assembly 148 is then actuated to move pivot cage 128 between an upright orientation (shown at the righthand side of FIG. 1) to a tilted orientation (shown at the left hand side of FIG. 1) at an angle to the vertical.

Motor 122 is now actuated to move pinion 120 in mating engagement with longitudinal racks 116 of inner member 100. This movement of pinions 120 raises plate 106, the upward movement of plate 106 being facilitated by the rolling movement of bearings 124 on either side of plate 106. The rotation of pinions 120 is continued until inner member 100 is moved through a distance relative to the outer member, from a retracted position in which inner member 100 is contained entirely within outer member 98, to an extended position in which a top portion of outer member 100 is extended through hatch 156 in steel plate 16 to a position adjacent hatch 158 in steel plate 14. When inner member 100 is in this extended position, projection 88 has moved through hatch 158 in steel plate 14. Another running tool (which is not shown) is then attached to projection 88 to pick up the extended pipe. The running tool is attached to a derrick which pulls pipe 10 out of the elevator and completely moves it through hatch 158. As the bottom portion of pipe 10 clears hatch 158, it is secured by means of tongs, chains or other means known in the art to move the bottom of pipe 10 to an opening 160 in plate 14. When the bottom of pipe 10 is aligned with opening 160, pipe 10 is lowered through opening 160 and moved into engagement with a nipple 162 on the top of BOP 30. Pipe 10 and BOP 30 are then lowered through moon pool 50. Pipe 10 is then secured in place as a second pipe 10 is lowered into mating engagement with it. The process is then repeated until a riser pipe of appropriate length has been constructed.

When it is necessary to break the string and remove the riser pipe, the aforementioned procedure is reversed. Riser pipe is raised through opening 160 until the bottom of the riser pipe clears the moon pool. The topmost riser pipe can then be disengaged from the next lower riser pipe, and the disengaged pipe is moved through opening 160 and reinserted down through hatch 158 into the riser pipe elevator which is in the totally extended position shown at the left hand side of FIG. 1. Inside member 100 is then retracted by rotation of pinion 120, and after the retraction assembly 148 moves pivot cage 128 from its tilted orientation to its vertical orientation. Motor 94 is then actuated to rotate pinion 96 and retract outer member 90 back down into its stored, vertical orientation.

It can be seen that the foregoing structure provides a means for moving the riser pipe through the open top of the magazine at an angle to the vertical along at least a portion of the length of the riser pipe. The pipe is thereby moved through the floor of the unit at an angle and presented at a position adjacent the drill center. The structure described above can be used to much more quickly assemble and disassemble the riser pipe. This time saving aspect of the invention is very critical on a drilling rig where time is of the essence. The faster speed with which the riser pipe can be disassembled is especially advantageous when the pipe must be disassembled in anticipation of an approaching storm. The shorter disassembly time permits operations to continue to within a much shorter time period of the anticipated arrival of the storm.

Movement of the riser pipe through the floor of the drilling rig at an angle helps keep the center of gravity of the riser pipe below the floor and prevents damage to the running tool which raises pipe 10 through hatch 158. Experimentation has shown that proper selection of the angle at which the riser pipe moves through hatches 156, 158 can even more greatly minimize bending moments on the running tool. For example, it has been found that when the hatch 158 is thirteen feet from center line 38, then an 8.9° angle is especially preferred in avoiding damage to the running tool.

This preferred embodiment of the invention has been disclosed in accordance with requirements of law. It will be appreciated by those skilled in the art that a broad range of equivalents can be employed without departing from the invention set forth in the following claims.

We claim:

1. An apparatus for storing and retrieving a riser pipe, comprising:

an upright, annular magazine comprised of an inside annular wall and an outside annular wall, the magazine having an open top;

means for storing the riser pipe in a substantially vertically oriented position within the annular magazine; and means for moving the riser pipe upwardly through the open top of the annular magazine at an angle to the vertical along at least a portion of the length of the riser pipe.

2. The apparatus of claim 1 wherein the means for moving the riser pipe is an elongated elevator cage in which the riser pipe is placed, the elevator cage being provided with means for raising and tilting the elevator cage.

3. The apparatus of claim 2 wherein the means for storing the riser pipe is a means for storing the riser pipe at a position remote from the elevator cage, and an overhead crane is provided adjacent the top of the magazine, the crane having means for grasping an upper end of the riser pipe and transporting the riser pipe in its vertical orientation between the remote position and elevator cage.

4. An apparatus for storing and retrieving a riser pipe, comprising:

an upright, annular magazine comprised of an inside annular wall and an outside annular wall, the magazine having an open top;

means for storing the riser pipe in a substantially vertically oriented position within the annular magazine; and means for moving the riser pipe through the open top of the annular magazine at an angle to the vertical along at least a portion of the length of the riser pipe, wherein the means for moving the riser pipe is an elongated elevator cage in which the riser pipe is placed, the elevator cage being provided with means for raising and tilting the elevator cage, wherein the means for storing the riser pipe is a means for storing the riser pipe at a position remote from the elevator cage, and an overhead crane is provided adjacent the top of the magazine, the crane having means for grasping an upper end of the riser pipe and transporting the riser pipe in its vertical orientation between the remote position and elevator cage, and wherein the elevator cage is comprised of an elongated outer member and an elongated inner member in telescopic relationship therewith, the outer member being provided with means for moving the riser pipe through a first distance relative to the magazine from a stored position to an extneded position, the inner member being provided with means for moving the riser pipe a second distance relative to the outer member from a retracted position to an extended position.

5. The apparatus of claim 4 wherein a pivot cage is pivotally attached to the magazine adjacent the open top for rotational movement of the pivot cage about a substantially horizontal axis, the pivot cage being provided with means for holding the outer member in fixed engagement therewith when the outer member is in an extended position, the pivot cage further being provided with means for moving the pivot cage about the pivotal attachment between an upright orientation and a tilted orientation.

6. The apparatus of claim 5 wherein the means for storing the riser pipe comprises upright stanchions disposed concentrically around the interior of the annular magazine, the stanchions being provided with horizontal support plates which are in supporting relationship to the vertically oriented riser pipes, and a pipe holding element on the bottom of the magazine, the pipe holding element being configured to fit in pipe holding engagement with a bottom of the riser pipe.

7. An apparatus for storing and retrieving a riser pipe in a semi-submersible drilling unit, comprising:

an annular caisson below a floor of the semi-submersible unit in surrounding relationship to the drill center of the unit for providing buoyant support, the annular caisson forming a magazine which is comprised of an annular inside wall and an annular outside wall, the magazine having an open annular top and a closed bottom;

means for storing the riser pipe in a substantially vertically oriented position within the annular magazine; and means for moving the riser pipe through the floor of the unit at an angle to the vertical along at least a portion of the length of the riser pipe.

8. The apparatus of claim 7 wherein the means for moving the riser pipe is an elongated elevator cage in which the riser pipe is placed, the elevator cage being provided with means for raising and tilting the elevator cage.

9. The apparatus of claim 8 wherein the means for storing the riser pipe is a means for storing the pipe at a position remote from the elevator cage, and an overhead crane is provided adjacent the top of the magazine, the crane having means for grasping an upper end of the riser pipe and transporting the riser pipe in its vertical orientation between the remote position and the elevator cage.

10. An apparatus for storing and retrieving a riser pipe in a semi-submersible drilling unit, comprising:

an annular caisson below a floor of the semi-submersible unit in surrounding relationship to the drill center of the unit for providing buoyant support, the annular caisson forming a magazine which is comprised of an annular inside wall and an annular outside wall, the magazine having an open annular top and a closed bottom;

means for storing the riser pipe in a substantially vertically oriented position within the annular magazine;

means for moving the riser pipe through the floor of the unit at an angle to the vertical along at least a portion of the length of the riser pipe, wherein the means for moving the riser pipe is an elongated elevator cage in which the riser pipe is placed, the elevator cage being provided with means for raising and tilting the elevator cage, wherein the means for storing the riser pipe is a means for storing the pipe at a position remote from the elevator cage, and an overhead crane is provided adjacent the top of the magazine, the crane having means for grasping an upper end of the riser pipe and transporting the riser pipe in its vertical orientation between the remote position and the elevator cage, and wherein the elevator cage is comprised of an elongated outer member and an elongated inner member in telescopic relationship with one another, the outer member being provided with means for moving the riser pipe through a first distance relative to the magazine from a stored position to an extended position, the inner member being provided with means for moving the riser pipe through a second distance relative to the outer member from a retracted position to an extended position.

11. The apparatus of claim 10 wherein a pivot cage is pivotally attached to the magazine adjacent the open top for rotational movement about a substantially horizontal axis, the pivot cage being provided with means for holding the outer member in fixed engagement therewith when the outer member is in an extended position, the pivot cage further being provided with means for moving the pivot cage about the pivotal attachment between an upright orientation and a tilted orientation.

12. The apparatus of claim 11 wherein the means for storing the riser pipe comprises upright stanchions disposed concentrically around the interior of the annular magazine, the stanchions being provided with horizontal support plates which are in supporting relationship to the vertically oriented riser pipes, and a pipe holding element on the bottom of the magazine, the pipe holding element being configured to fit in pipe holding engagement with a bottom of the riser pipe.

13. The apparatus of claim 12 wherein the inside face of the annular outside wall is provided with an indentation which is adjacent the bottom of the outer member when the outer member is in an extended position for receiving a portion of the outer member in the indentation when the elevator cage is in its tilted orientation.

14. An apparatus for storing and retrieving a riser pipe in a semi-submersible drilling unit, comprising:

an annular caisson below a floor of the semi-submersible drilling unit in surrounding relationship to the center of the unit for providing buoyant support, the annular caisson forming a magazine which is comprised of an annular inside wall and an annular outside wall, the magazine having an open annular top and a closed bottom, the inside face of the annular outside wall being provided with an indentation;

a plurality of upright stanchions disposed around the interior of the annular magazine, the stanchions being provided with horizontal support plates which are in supporting relationship to the vertically oriented riser pipes stored therebetween;

a pipe holding element on the bottom of the magazine, the pipe holding element being configured to fit in pipe holding engagement with a bottom of the riser pipe;

an overhead crane adjacent the top of the magazine which is provided with a gripping member for gripping a top of the riser pipe, and an arcuate track around the interior of the magazine to which the crane is connected in guided engagement;

an elongated elevator cage within the magazine for raising riser pipe out of the open top of the annular magazine, the elevator cage being comprised of an elongated outer member and an elongated inner member in telescopic relationship, the outer member being provided with a longitudinal rack which mates with a pinion fixed to the magazine for moving the outer member through a first distance relative to the magazine from a stored position to an extended position, the inner member being provided with a longitudinal rack which mates with a pinion fixed to the outer member for movement of the inner member through a second distance relative to the outer member, from a retracted position to an extended position; a pivot cage pivotally attached adjacent the top of the magazine for rotational movement about a substantially horizontal axis; the pivot cage being provided with a selectively actuated pin that mates with a pin receiving opening in the outer member to hold the outer member in selectively fixed engagement with the pivot cage when the outer member is in the extended position; and a fluid actuated piston and cylinder assembly fixed at a first end to the magazine and at a second end to the pivot cage for moving the pivot cage about the pivotal attachment between an upright orientation and a tilted orientation.

15. A method for storing and retrieving a riser pipe, comprising the steps of:

providing an upright annular magazine comprised of an inside annular wall and an outside annular wall, the magazine having an open top;

storing the riser pipe in a substantially vertically oriented position within the annular magazine; and moving the riser pipe upwardly through the open top of the annular magazine at an angle to the vertical along at least a portion of the length of the riser pipe.

16. The method of claim 15 wherein the riser pipe is moved through the top of the magazine in an elongated elevator cage in which the riser pipe is placed, the elevator cage being provided with means for raising and tilting the elevator cage.

17. The method of claim 16 wherein the riser pipe is stored at a position remote from the elevator cage, and the riser pipe is transported between the remote position and the elevator cage for storage and retrieval.

18. A method for storing and retrieving a riser pipe, comprising the steps of:

providing an upright annular magazine comprised of an inside annular wall and an outside annular wall, the magazine having an open top;

storing the riser pipe in a substantially vertically oriented position within the annular magazine; and moving the riser pipe through the open top of the annular magazine at an angle to the vertical along at least a portion of the length of the riser pipe, wherein the riser pipe is moved through the top of the magazine in an elongated elevator cage in which the riser pipe is placed, the elevator cage being provided with means for raising and tilting the elevator cage, wherein the riser pipe is stored at a position remote from the elevator cage, and the riser pipe is transported between the remote position and the elevator cage for storage and retrieval, and wherein the elevator cage is comprised of an elongated outer member and an elongated inner member in telescopic relationship to one another, the outer member moving the riser pipe through a first distance relative to the magazine from a stored position to an extended position, the inner member moving the riser pipe a second distance relative to the outer member from a retracted position to an extended position.

19. The method of claim 18 wherein the elevator cage is pivoted about a substantially horizontal axis in a pivot cage pivotally attached to the magazine adjacent the open top, the pivot cage being fixed to the outer member when the outer member is in an extended position.

20. A method for storing and retrieving a riser pipe in a semi-submersible drilling unit, comprising the steps of:

providing an annular caisson below a floor of the semi-submersible unit in surrounding relationship to the center of the unit for providing buoyant support, the annular caisson forming a magazine which is comprised of an annular inside wall and an annular outside wall, the magazine having an open annular top;

storing the riser pipe in a substantially vertically oriented position within the annular magazine; and moving the riser pipe through the floor of the semi-submersible unit at an angle to the vertical along at least a portion of the length of the riser pipe.

21. The method of claim 20 wherein the riser pipe is moved towards the floor of the unit in an elongated elevator cage in which the riser pipe is placed, the elevator cage being provided with means for raising and tilting the elevator cage.

22. The method of claim 21 wherein the riser pipe is stored at a position remote from the elevator cage, and the riser pipe is transported while vertically oriented between the remote position and the elevator cage for storage and retrieval.

23. A method for storing and retrieving a riser pipe in a semi-submersible drilling unit, comprising the steps of:

providing an annular caisson below a floor of the semi-submersible unit in surrounding relationship to the center of the unit for providing buoyant support, the annular caisson forming a magazine which is comprised of an annular inside wall and an annular outside wall, the magazine having an open annular top;

storing the riser pipe in a substantially vertically oriented position within the annular magazine;

moving the riser pipe through the floor of the semi-submersible unit at an angle to the vertical along at least a portion of the length of the riser pipe, wherein the riser pipe is moved towards the floor of the unit in an elongated elevator cage in which the riser pipe is placed, the elevator cage being provided with means for raising and tilting the elevator cage, wherein the riser pipe is stored at a position remote from the elevator cage, and the riser pipe is transported while vertically oriented between the remote position and the elevator cage for storage and retrieval, and wherein the elevator cage is comprised of an elongated outer member and an elongated inner member in telescopic relationship therewith, the outer member moving the riser pipe through a first distance relative to the magazine from a stored position to an extended position, the inner member moving the riser pipe a second distance relative to the outer member from a retracted position to an extended position.

24. The method of claim 23 wherein the elevator cage is pivoted about a substantially horizontal axis in a pivot cage pivotally attached to the magazine adjacent the open top, the pivot cage being fixed to the outer member when the outer member is in an extended position.

25. The method of claim 24 wherein the inside face of the annular outside wall is provided with an indentation which is adjacent the bottom of the outer member when the outer member is in the extended position, a portion of the bottom of the elevator cage moving into the indentation when the elevator cage is moved to its tilted orientation.

* * * * *